US007297005B1

(12) United States Patent
Zaderej

(10) Patent No.: US 7,297,005 B1
(45) Date of Patent: Nov. 20, 2007

(54) CONNECTOR PEDESTAL

(75) Inventor: Victor Zaderej, St. Charles, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/475,711

(22) Filed: Jun. 27, 2006

(51) Int. Cl.
*H01R 12/00* (2006.01)

(52) U.S. Cl. ..... 439/74; 439/64; 439/931

(58) Field of Classification Search ..... 439/74, 439/64, 931, 637
See application file for complete search history.

(56) References Cited

U.S. PATENT DOCUMENTS 4,639,062 A * 1/1987 Taniguchi et al. ..... 439/586
4,738,625 A * 4/1988 Burton et al. ..... 439/59
5,868,582 A * 2/1999 Jacobi ..... 439/74
6,253,451 B1 * 7/2001 Semmeling et al. ..... 29/842
6,312,263 B1 * 11/2001 Higuchi et al. ..... 439/66
2005/0221680 A1 * 10/2005 Yasumura et al. ..... 439/676

* cited by examiner

*Primary Examiner*—Michael C. Zarroli
*Assistant Examiner*—Phuongchi Nguyen
(74) *Attorney, Agent, or Firm*—Robert J. Zietler

(57) ABSTRACT

A connector pedestal has a body which includes interior and exterior surfaces, upper and lower edges, and interface portion, and first and second sets of traces. The interface portion is provided proximate to the upper edge and is configured to be connected to a connector. The first set of traces extends along the interior surface from the upper edge to the lower edge and around the lower edge onto the exterior surface. The second set of traces extends along the exterior surface from the upper edge to the lower edge and around the lower edge onto the interior surface. The traces of the first and second sets proximate to the lower edge are configured to be connected to a circuit board.

22 Claims, 4 Drawing Sheets

CONNECTOR PEDESTAL

FIELD OF THE INVENTION

The present invention relates to a connector pedestal for use in a connector assembly.

BACKGROUND OF THE INVENTION

In the electronics industry, packaging constraints are becoming ever more difficult. The size, weight, heat and location of electronic components are making these requirements an increasing challenge to designers. As such, it would be desirable to have a transition connector which can be used to either raise or lower the position of a connector with respect to a main printed wiring board. It would further be desirable to provide an interface to a mating connector which can be modified to accommodate the dimensions of the mating connector without changing or customizing the connector itself.

The present invention provides such a transition connector in the form of a connector pedestal.

SUMMARY OF THE INVENTION

A connector pedestal has a body including interior and exterior surfaces, upper and lower edges, and interface portion, and first and second sets of traces. The interface portion is provided proximate to the upper edge. The first set of traces extends along the interior surface from the upper edge to the lower edge and around the lower edge onto the exterior surface. The second set of traces extends along the exterior surface from the upper edge to the lower edge and around the lower edge onto the interior surface. The connector pedestal is formed by a two-shot or double-shot injection molding process.

In a connector assembly, the connector pedestal is mounted to a main circuit board by the traces of the first and second sets proximate to the lower edge of the connector pedestal being soldered to the main circuit board. The connector assembly further includes a guide cage mounted to the main circuit board and a secondary circuit board which is positioned on and guided into position by the guide cage such that the secondary circuit board is positioned off of the main circuit board by a predetermined distance. A connector is further included which is secured to the secondary circuit board and connected to the interface portion of the connector pedestal.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENT

Figure 1:
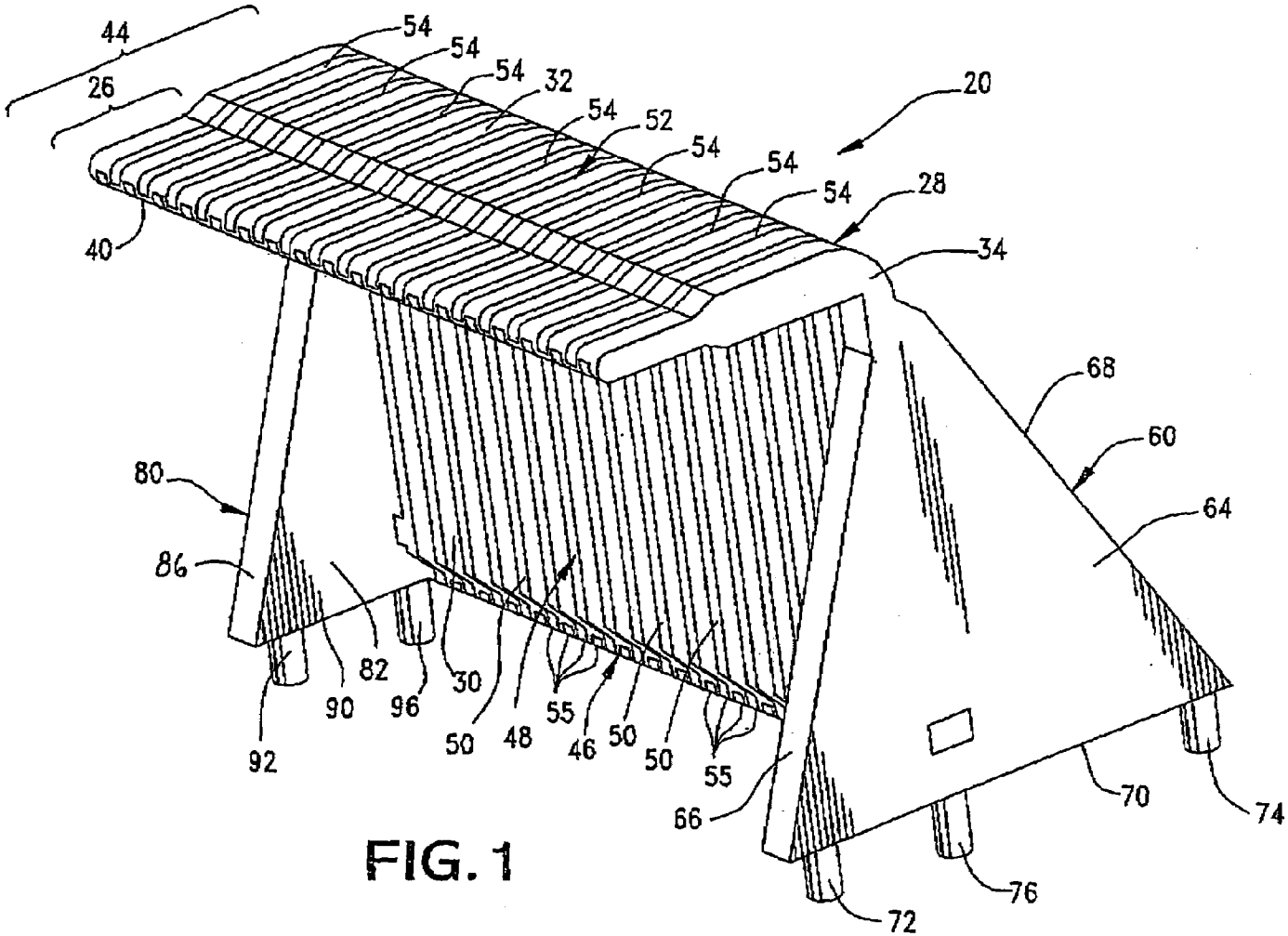
FIG. 1 is a front perspective view of a connector pedestal which incorporates features of the invention.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

The invention herein provides a connector pedestal 20 that can be used to either raise or lower the position of a connector 22 with respect to a main printed wiring board (Main PWB) 24. An interface portion 26 of the connector pedestal 20 to the mating connector 22 can be modified to accommodate the dimensions of the mating connector 22 without changing or customizing the connector 22 itself.

Figure 2:
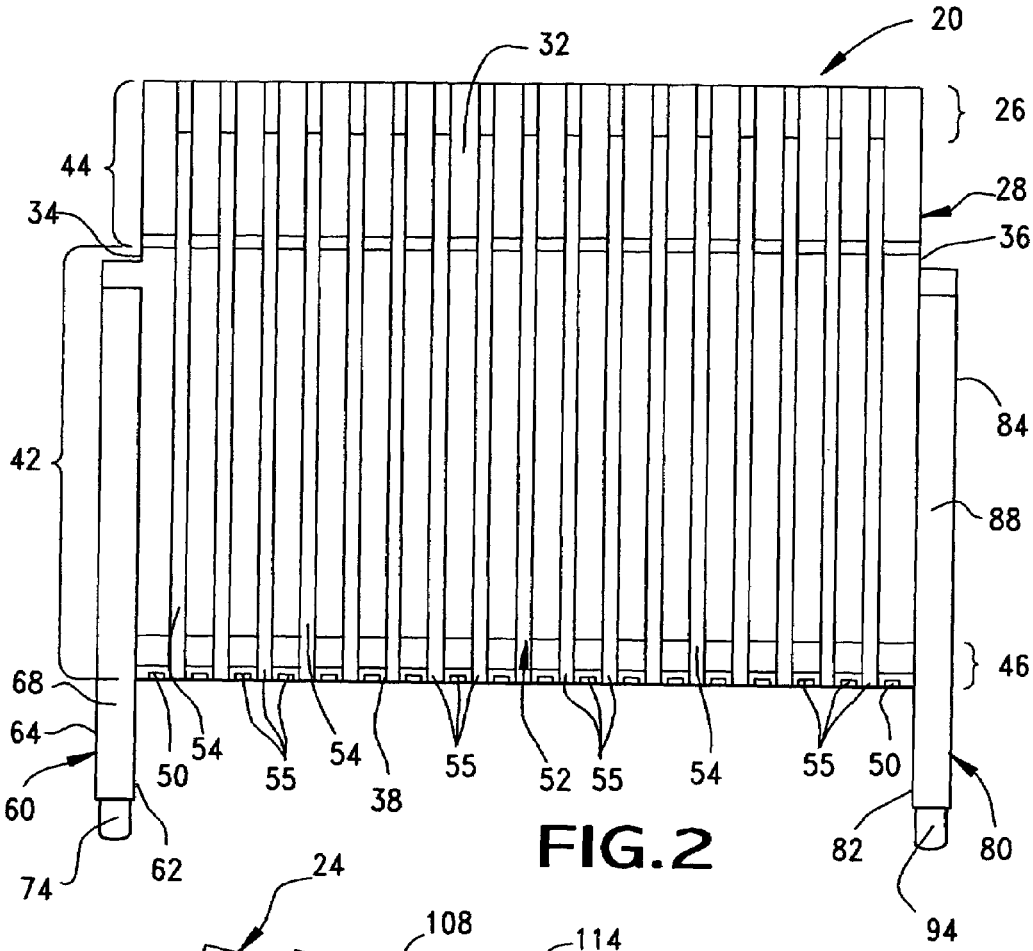
FIG. 2 is a rear perspective view of the connector pedestal.
Figure 3:
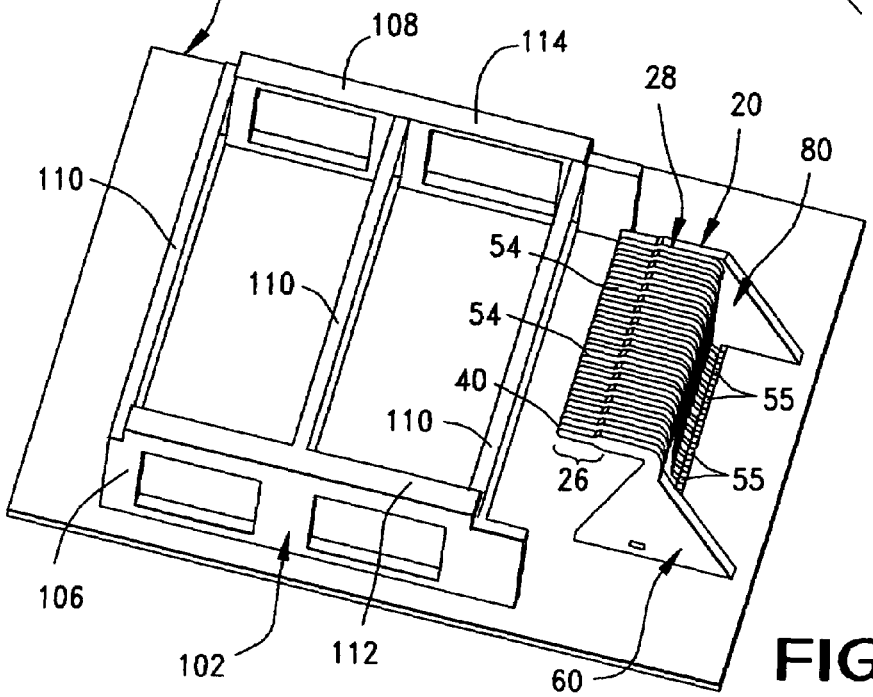
FIG. 3 is a rear perspective view of a portion of a connector assembly including the connector pedestal.

FIGS. 1-3 best illustrate the connector pedestal 20. The connector pedestal 20 includes a generally L-shaped body 28 having an interior surface 30, an exterior surface 32, a first side edge 34, a second side edge 36, a lower edge 38 and an upper edge 40. The lower and upper edges 38, 40 are preferably rounded. The L-shaped body 28 is generally formed from a first portion 42 and a second portion 44, which are preferably integrally formed, and the connection of the first and second portions 42, 44 is preferably rounded. The first and second portions 42, 44 are preferably perpendicular to one another, such that the lower and upper edges 38, 40 are preferably perpendicular to one another.

The first portion 42 is generally defined by the first and second side edges 34, 36, and the lower edge 38. The first portion 42 is provided with an offset portion 46 proximate to the lower edge 38, which preferably spans an entire length of the first portion 42 from the first side edge 34 to the second side edge 36.

The second portion 44 is generally defined by the first and second side edges 34, 36, and the upper edge 40. The second portion 44 is provided with the interface portion 26 proximate to the upper edge 40, which preferably spans an entire length of the second portion 44 from the first side edge 34 to the second side edge 36. The interface portion 26 has a reduced thickness across the entire length of the second portion 44 from the first side edge 34 to the second side edge 36 relative to the remainder of the second portion 44.

The L-shaped body 28 of the connector pedestal 20 is provided with a first set 48 of traces 50 and a second set 52 of traces 54.

The first set 48 of traces 50 are provided along the interior surface 30 of the L-shaped body 28 from the lower edge 38 to the upper edge 40. The first set 48 of traces 50 also extends around the lower edge 38 of the L-shaped connector 28 onto the exterior surface 32 of the L-shaped body 28, but preferably does not extend beyond the offset portion 46 of the first portion 42 of the L-shaped body 28. The first set 48 of traces 50 may also slightly extend around the upper edge 40 of the L-shaped connector 28 onto the exterior surface 32 of the L-shaped body 28, if desired.

The second set 52 of traces 54 are provided along the exterior surface 32 of the L-shaped body 28 from the lower edge 38 to the upper edge 40. The second set 52 of traces 54 also extends around the lower edge 38 of the L-shaped connector 28 onto the interior surface 30 of the L-shaped body 28, but preferably does not extend beyond the offset portion 46 of the first portion 42 of the L-shaped body 28. The second set 52 of traces 50 may also slightly extend around the upper edge 40 of the L-shaped connector 28 onto the interior surface 30 of the L-shaped body 28, if desired.

The traces 50, 54 which extend around the lower edge 38 of the first portion 42 of the L-shaped body 28 are defined as the solder or SMT feet 55 of the connector pedestal 20.

The traces 50 of the first set 48 preferably alternate along the length of the L-shaped body 28 with the traces 54 of the second set 52, but are not required to alternate. For example, as best illustrated in FIGS. 1 and 2, one of the traces 50 of the first set 48 is provided next and proximate to the first side edge 34 of the L-shaped body 28, one of the traces 54 of the second set 52 is provided next to the trace 50 of the first set 48 which is provided next and proximate to the first side edge 34 of the L-shaped body 28, and another one of the traces 50 of the first set 48 is provided next to the trace 54 of the second set 48, and so forth, until another one of the traces 50 of the first set 48 is provided next and proximate to the second side edge 36 of the L-shaped body 28. It is to be understood that while it is described and illustrated that traces 50 of the first set 48 are provided next to and proximate to the first and second side edges 34, 36 of the L-shaped body 28, that it is possible, if desired, to have the traces 54 of the second set 52 be provided next to and proximate to the first and second side edges 34, 36 of the L-shaped body 28, or to have one of the traces 50 of the first set 48 be provided next to and proximate to one of the first and second side edges 34, 36 and to have one of the traces 54 of the second set 52 be provided next to and proximate to the other of the first and second side edge 34, 36.

The connector pedestal 20 includes a first wing member 60 which is generally triangular in configuration such that it has an inner surface 62, an outer surface 64, and first, second and third side edges 66, 68, 70. The first side edge 66 is connected at one end thereof to the second side edge 68 and at an opposite end thereof to the third side edge 70. The second side edge 68 is connected at one end thereof to the third side edge 70 and at an opposite end thereof to the first side edge 66. The third side edge 70, also referred to herein as a bottom edge 70 of the first wing member 60, is connected at one end thereof to the first side edge 66 and at an opposite end thereof to the second side edge 68. The first side edge 34 of the first portion 42 of the L-shaped body 28 of the connector pedestal 20 is secured to, and preferably integrally formed with, the inner surface 62 of the first wing member 60, with the connection of the first and second side edges 66, 68 of the first wing member 60 being provided proximate to the connection of the first and second portions 42, 44 of the L-shaped body 28. The bottom edge 70 of the first wing member 60 is proximately planar with the lower edge 38 of the L-shaped body 28.

The first wing member 60 is preferably provided with a pair of positioning feet 72, 74 which extend downwardly from the third edge side 70 thereof. The positioning feet 72, 74 are preferably integrally formed with the third side edge 70 of the first wing member 60. The positioning foot 72 preferably extends downwardly from the third side edge 70 proximate to the connection of the first side edge 66 and the third side edge 70. The positioning foot 74 preferably extends downwardly from the third side edge 70 proximate to the connection of the second side edge 68 and the third side edge 70. The first wing member 60 is also preferably provided with a soldering foot 76 which extends downwardly from the third side edge 70 thereof, preferably between the positioning feet 72, 74.

The connector pedestal 20 includes a second wing member 80 which is generally triangular in configuration such that it has an inner surface 82, an outer surface 84, and first, second, and third side edges 86, 88, 90. The first side edge 86 is connected at one end thereof to the second side edge 88 and at an opposite end thereof to the third side edge 90. The second side edge 88 is connected at one end thereof to the third side edge 90 and at an opposite end thereof to the first side edge 86. The third side edge 90, also referred to herein as a bottom edge 90 of the second wing member 80, is connected at one end thereof to the first side edge 86 and at an opposite end thereof to the second side edge 88. The second side edge 36 of the first portion 42 of the L-shaped body 28 of the connector pedestal 20 is secured to, and preferably integrally formed with, the inner surface 82 of the second wing member 80, with the connection of the first and second side edges 86, 88 of the second wing member 80 being provided proximate to the connection of the first and second portions 42, 44 of the L-shaped body 28. The bottom edge 90 of the second wing member 80 is proximately planar with the lower edge 38 of the L-shaped body 28.

The second wing member 80 is preferably provided with a pair of positioning feet 92, 94 which extend downwardly from the third side edge 90 thereof. The positioning feet 92, 94 are preferably integrally formed with the third side edge 90 of the second wing member 80. The positioning foot 92 preferably extends downwardly from the third side edge 90 proximate to the connection of the first side edge 86 and the third side edge 90. The positioning foot 94 preferably extends downwardly from the third side edge 90 proximate to the connection of the second side edge 88 and the third side edge 90. The second wing member 80 is also preferably provided with a soldering foot 96 which extends downwardly from the third side edge 90 thereof, preferably between positioning feet 92, 94.

The connector pedestal 20 is preferably formed by a two-shot or double-shot injection molding process. In the two-shot injection molding process, a first cavity and core is provided into which a non-plateable or plateable thermoplastic is injected to form a first molded product. The first molded product stays on the core and is rotated to be placed into a second cavity as an insert and a plateable or non-plateable thermoplastic and is injected therein and molded against the first molded product, commonly known as over-molding, to form a second molded product formed of a combination of the non-plateable and plateable thermoplastics. The second molded product is then subjected to an etching process and electroless plating bath, such that metal from the electroless bath adheres only to the plateable thermoplastic of the second molded product.

In the connector pedestal 20 of the present invention, nearly all of the L-shaped body 28 is formed with the non-plateable thermoplastic whereas only those portions of the L-shaped body 28 positioned below the first and second set 48, 52 of traces 50, 54 are formed with the plateable thermoplastic, such that the traces 50, 54 can be formed on the L-shaped body 28 by the electroless bath. Also, in the connector pedestal 20 of the present invention, nearly all of the first and second wing members 60, 80 are formed with the non-plateable thermoplastic whereas only those portions of the first and second wing members 60, 80 positioned proximate to the soldering feet 76, 96 can be formed on the first and second wing members 60, 80 by the electroless bath.

Figure 4:
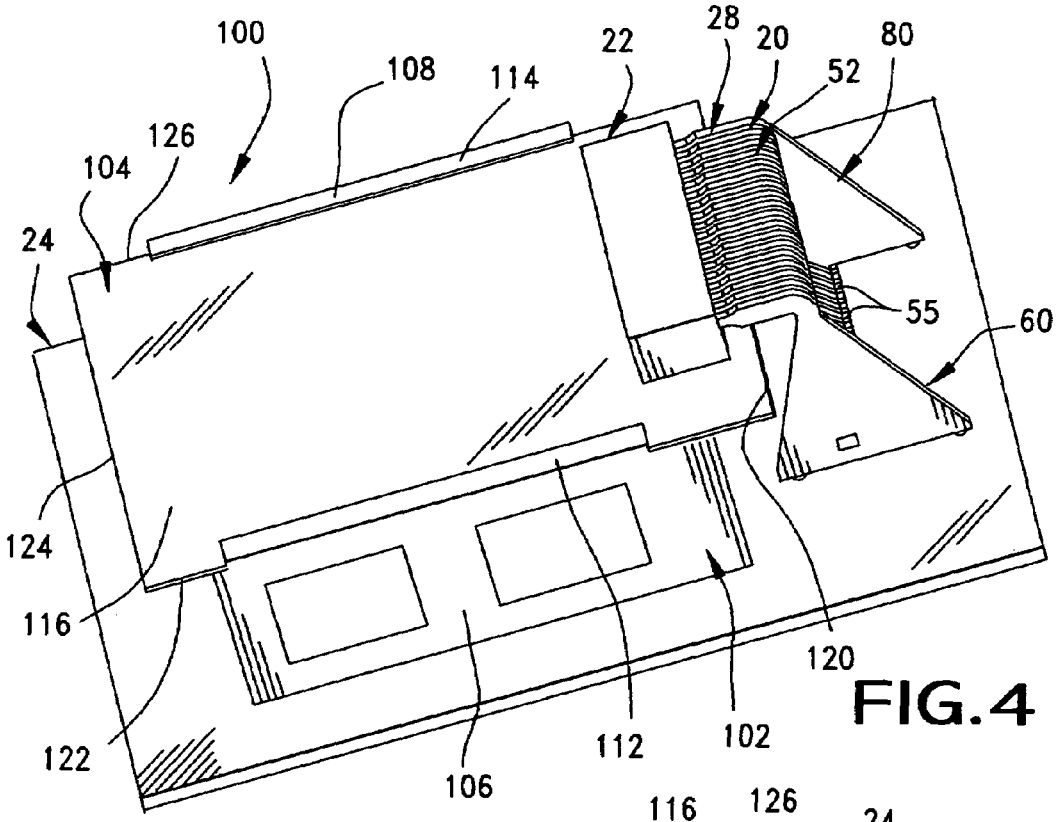
FIG. 4 is a side perspective view of a whole connector assembly including the connector pedestal.
Figure 5:
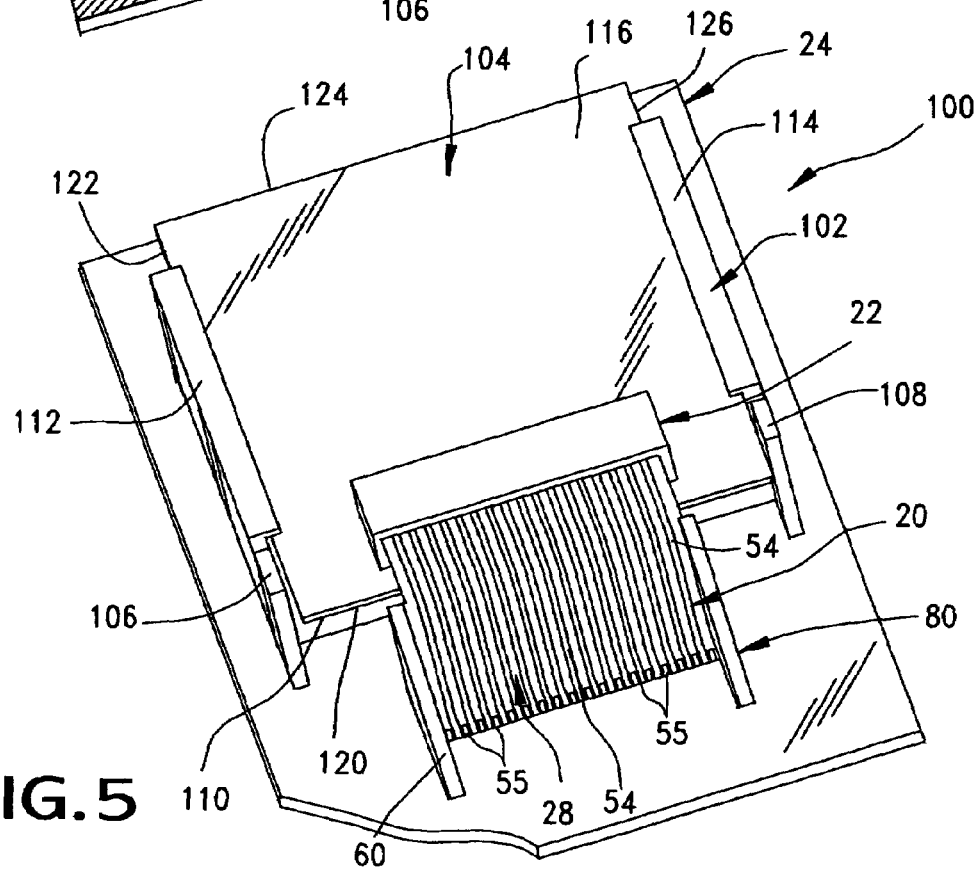
FIG. 5 is a rear perspective view of the whole connector assembly including the connector pedestal.
Figure 6:
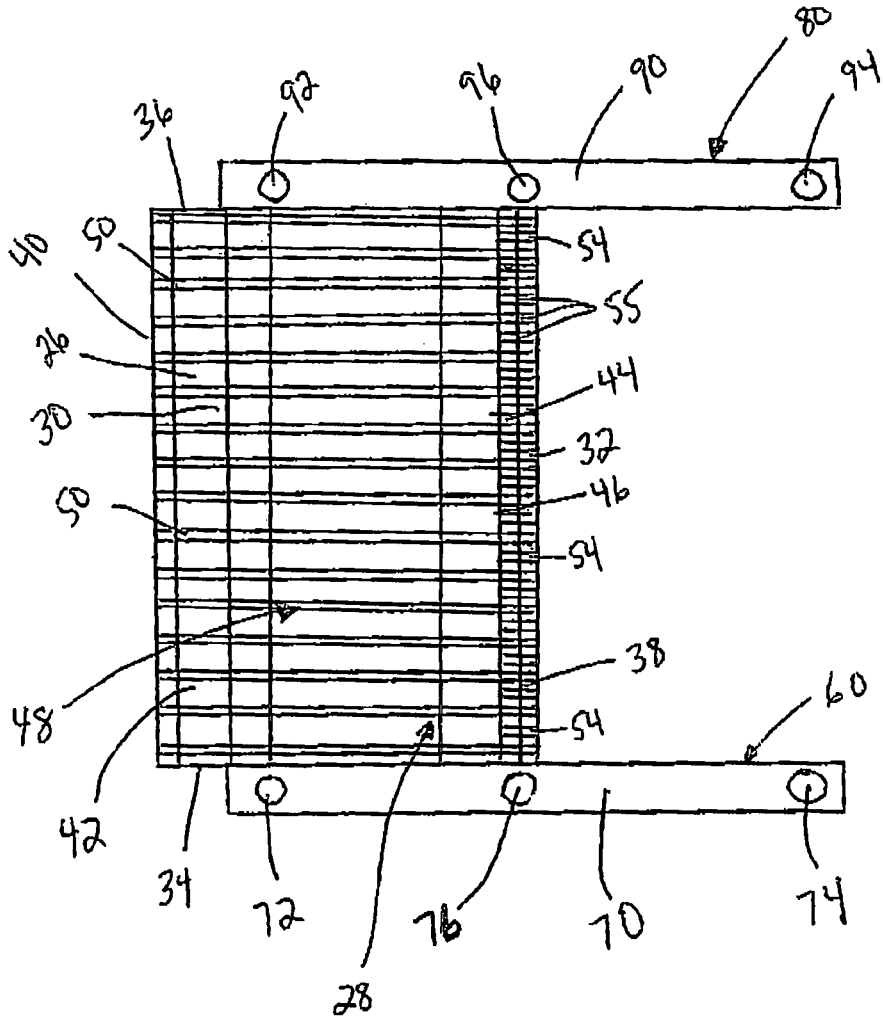
FIG. 6 is a bottom view of the connector pedestal.

The connector pedestal 20 is preferably utilized in a connector assembly 100, as best illustrated in FIGS. 3-5. The connector assembly 100 includes the connector pedestal 20, the connector 22, the main PWB 24, a guide cage 102, and a secondary circuit board 104.

The connector pedestal 20 is mounted onto the main PWB 24 using conventional assembly and soldering techniques. The solder feet 55 are soldered to the main PWB 24, using standard surface mount technology ("SMT") processing, thus securing the connector pedestal 20 to the main PWB 24.

If the positioning and soldering feet 72, 74, 76; 92, 94, 96 of the first and second wing members 60, 80, respectively, of the connector pedestal 20 are provided, these may also be used to properly position the connector pedestal 20 to the main PWB 24, as well as to provide increased hold down strength of the connector pedestal 20 to the main PWB 24.

If the first and second wing members 60, 80 are provided with the positioning and soldering feet 72, 74, 76; 92, 94, 96, respectively, the main PWB 24 preferably includes two separated pairs of apertures (not shown) therein. The connector pedestal 20 is mounted onto the main PWB 24 by positioning the positioning feet 72, 74 of the first wing member 60 into one of the pairs of apertures of the main PWB 24, and by positioning the positioning feet 92, 94 of the second wing member 80 into the other one of the pairs of apertures of the main PWB 24. The soldering feet 76, 96 are then soldered to the main PWB 24 using conventional techniques in order to secure the first and second wing members 60, 80, and thus the connector pedestal 20, to the main PWB 24.

The guide cage 102, which is best illustrated in FIG. 3, includes a first guide member 106, a second guide member 108, and a plurality of cross-members 110 extending between the first and second guide members 106, 108. The bottom edges of the first and second guide members 106, 108 are mounted to the main PWB 24 using conventional techniques. The upper edges 112, 114 of the first and second guide members 106, 108 are preferably folded over inwardly toward one another and above the cross-members 110.

The secondary circuit board 104 has an upper surface 116, a lower surface (not shown) and first, second, third, and fourth edges 120, 122, 124, 126. The secondary circuit board 104 is provided with various electronics thereon that must be interconnected to the main PWB 24. This is accomplished by mounting the connector 22, which is preferably an XFP connector, for instance a 70 position XFP connector, onto the upper surface 116 of the secondary circuit board 104 proximate to the first edge 120, and between the second and fourth edges 122, 126.

The secondary circuit board 104, with the connector 22 mounted thereon, is slid/moved, with the first edge 120 leading, into the guide cage 102 between the first and second guide members 106, 108, and between the cross-members 110 and the folded-over upper edges 112, 114 of the first and second guide members 106, 108. The connector 22 is thus mounted on the secondary circuit board 104 in such a position that the connector 22 will mate with the interface portion 26 of the second portion 44 of the L-shaped body 28 of the connector pedestal 20, as this portion 26 has a reduced thickness, thus forming the completed connector assembly 100. The secondary circuit board 104 may preferably rest on the cross-members 110 of the guide cage 102. The first and second set 48, 50 of traces 52, 54 thus interconnect the electronics on the main PWB 24 to the electronics on the secondary circuit board 104, through the upper edge 40 of the pedestal connector 22. The upper edge 40 thereby is a substitute for having a connector to mate with the connector 22. Because it is not necessary to have a mating connector, the pedestal provides design flexibility as well as reduced overall system costs and complexity.

It should be noted that the size of the connector pedestal 20 and the guide cage 102 can be varied depending on the desired distance to be provided between the main PWB 24 and the secondary circuit board 104.

As best illustrated in FIGS. 3 and 5, which are rear views of the connector assembly 100, in partial and whole form, all of the traces of 50, 54 are exposed in the rear, on the exterior surface 32 of the offset portion 46 of the first portion 42 of the L-shaped body 28 of the connector pedestal 20, thus allowing for ease in inspection of the solder joints which join the traces 50, 54 to the main PWB 24. Thus, by using half the contacts in the connector 22, such as a 70 position XFP connector, it is possible to route the traces 50, 54 on the connector pedestal 20 in a way that all of the SMT contacts (traces 50, 54) soldered to the main PWB 24, are exposed on the rear of the connector pedestal 20. This eliminates the concern about inspection of the solder joints after assembly for joints that may be under the device.

The first and second wing members 60, 80 are provided on the connector pedestal 20 in order to provide support for the connector assembly 100 both during assembly and use. As explained, the positioning and soldering feet 72, 74, 76; 92, 94, 96 may be provided on the first and second wing members 60, 80 in order to provide hold down strength as well as positioning of the connector assembly 100.

The size of the interface portion 26 of the connector pedestal 20 can also be modified as desired, e.g., length, thickness, depth, etc., in order to accommodate the dimensions of the connector 22.

While a preferred embodiment of the invention is shown and described, it is envisioned that those skilled in the art may devise various modifications without departing from the spirit and scope of the foregoing description and the attached claims.

The invention claimed is:

1. A connector pedestal comprising:

a body having interior and exterior surfaces, upper and lower edges, and an interface portion proximate to said upper edge configured to be connected to a connector; and first and second sets of traces, said first set of traces extending along said interior surface from said upper edge to said lower edge and around said lower edge onto said exterior surface, said second set of traces extending along said exterior surface from said upper edge to said lower edge and around said lower edge onto said interior surface, said traces of said first and second sets proximate to said lower edge configured to be secured to a main printed wiring board.

2. The connector pedestal as defined in claim 1, wherein said upper and lower edges are rounded.

3. The connector pedestal as defined in claim 1, wherein said upper and lower edges are generally perpendicular to one another.

4. The connector pedestal as defined in claim 1, wherein said first set of traces extends around said upper edge onto said exterior surface.

5. The connector pedestal as defined in claim 1, wherein said second set of traces extends around said upper edge onto said interior surface.

6. The connector pedestal as defined in claim 1, wherein said first set of traces extends around said upper edge onto said exterior surface, and wherein said second set of traces extends around said upper edge onto said interior surface.

7. The connector pedestal as defined in claim 1, said body further being defined by first and second side edges, said first and second set of traces being provided in an alternating configuration from said first side edge to said second side edge.

8. The connector pedestal as defined in claim 1, said body further being defined by first and second side edges, one of said traces of said first set of traces being provided next and proximate to said first side edge, and another one of said traces of said first set of traces being provided next and proximate to said second side edge.

9. The connector pedestal as defined in claim 1, wherein said connector pedestal is formed from a two-shot or double-shot injection molding process.

10. The connector pedestal as defined in claim 1, wherein said body is formed of first and second portions which are provided generally perpendicularly to one another such that said body is generally L-shaped.

11. The connector pedestal as defined in claim 10, wherein said interface portion is provided in said second portion, said interface portion having a reduced thickness across a length of said second portion relative to a remainder of said second portion.

12. The connector pedestal as defined in claim 10, wherein said first and second portions are integrally formed.

13. The connector pedestal as defined in claim 1, further including an offset portion proximate to said lower edge.

14. The connector pedestal as defined in claim 13, wherein said portion of said first set of traces which extends around said lower edge onto said exterior surface does not extend beyond said offset portion.

15. The connector pedestal as defined in claim 13, wherein said portion of said second set of traces which extends around said lower edge onto said interior surface does not extend beyond said offset portion.

16. The connector pedestal as defined in claim 13, wherein said portion of said first set of traces which extends around said lower edge onto said exterior surface does not extend beyond said offset portion, and wherein said portion of said second set of traces which extends around said lower edge onto said interior surface does not extend beyond said offset portion.

17. The connector pedestal as defined in claim 1, said body further being defined by first and second side edges and first and second wing members, said first wing member having an inner surface which is connected to said first side edge, said second wing member having an inner surface which is connected to said second side edge, each of said wing members having a bottom edge which is proximately planar with said lower edge.

18. The connector pedestal as defined in claim 17, wherein said first and second wing members are generally triangular in configuration.

19. The connector pedestal as defined in claim 17, wherein at least one of said first and second wing members has at least one positioning foot extending downwardly from said bottom edge thereof, said at least one positioning foot of said at least one of said first and second wing members being configured to properly position said connector pedestal on the main printed wiring board.

20. The connector pedestal as defined in claim 17, wherein at least one of said first and second wing members has at least one soldering foot extending downwardly from said bottom edge thereof, said at least one soldering foot of said at least one of said first and second wing members being configured to be soldered to the main printed wiring board.

21. A connector pedestal comprising:

a body having, interior and exterior surfaces, rounded upper and lower edges, first and second side edges, integrally formed first and second portions which are provided generally perpendicular to one another such that said body is generally L-shaped, an interface portion formed on said second portion proximate to said upper edge which is configured to be connected to a connector, said interface portion has a reduced thickness from said first side edge to said second side edge relative to a remainder of said second portion, and an offset portion formed on said first portion proximate to said lower edge; and a first set of traces which extends along said interior surface from said upper edge to said lower edge and around said lower edge onto said exterior surface, but not beyond said exterior surface of said offset portion, said traces of said first set of traces proximate to said lower edge configured to be secured to a main printed wiring board, one of said traces of said first set of traces being provided next and proximate to said first side edge, and another one of said traces of said first set of traces being provided next and proximate to said second side edge;

a second set of traces which extends along said exterior surface from said upper edge to said lower edge and around said lower edge onto said interior surface, but not beyond said interior surface of said offset portion, said traces of said second set of traces proximate to said lower edge configured to be secured to the main printed wiring board, said first and second set of traces being provided in alternating configuration from said first side edge to said second side edge; and first and second generally triangular wing members, said first wing member having an inner surface which is connected to said first side edge, said second wing member having an inner surface which is connected to said second side edge, each of said wing members having a bottom edge which is proximately planar with said lower edge, at least one of said first and second wing members having at least one positioning foot extending downwardly from said bottom edge thereof, said at least one positioning foot of said at least one of said first and second wing members being configured to properly position said body on the main printed wiring board, at least one of said first and second wing members having at least one soldering foot extending downwardly from said bottom edge thereof, said at least one soldering foot being configured to be soldered to the main printed wiring board.

22. A connector assembly comprising:

a main printed wiring board;

a connector pedestal being mounted to said main printed wiring board, said connector pedestal comprising a body and first and second sets of traces, said body having interior and exterior surfaces, upper and lower edges, and an interface portion proximate to said upper edge, said first set of traces extending along said interior surfaces from said upper edge to said lower edge and around said lower edge onto said exterior surface, said second set of traces extending along said exterior surface from said upper edge to said lower edge and around said lower edge onto said interior surface, said traces of said first and second sets proximate to said lower edge being secured to said main printed wiring board;

a guide cage mounted to said main printed wiring board;

a secondary circuit board which is positioned on and guided into position by said guide cage such that said secondary circuit board is positioned off of said main printed wiring board by a predetermined distance; and a connector secured to said secondary circuit board, said connector configured to be connected to said interface portion of said body of said connector pedestal.

* * * * *